United States Patent [19]

Riemenschneider

[11] Patent Number: 4,706,442

[45] Date of Patent: Nov. 17, 1987

[54] STRETCH FILM WRAPPING DEVICE

[75] Inventor: Paul K. Riemenschneider, Grandville, Mich.

[73] Assignee: Highlight Industries, Inc., Grandville, Mich.

[21] Appl. No.: 867,775

[22] Filed: May 27, 1986

[51] Int. Cl.[4] ..... B65B 13/04

[52] U.S. Cl. ..... 53/556; 53/587; 53/588; 53/390

[58] Field of Search ..... 53/556, 587, 390, 588; 242/75.4, 96, 99, 156.2

[56] References Cited

U.S. PATENT DOCUMENTS

| | | | |
|---|---|---|---|
| 1,078,393 | 11/1913 | Wardwell et al. . | |
| 1,165,362 | 12/1915 | Ross . | |
| 1,449,851 | 3/1923 | Bjorge . | |
| 1,525,157 | 2/1925 | Thayer . | |
| 1,541,969 | 6/1925 | Kozak | 242/156.2 |
| 1,821,600 | 9/1931 | Whitehead . | |
| 1,875,436 | 9/1932 | Frese . | |
| 2,083,927 | 6/1937 | Sinex . | |
| 2,273,328 | 2/1942 | Miller . | |
| 2,350,636 | 6/1944 | Piron . | |
| 2,471,346 | 5/1949 | Peterson et al. . | |
| 2,574,216 | 11/1951 | Lindgren | 242/99 |
| 2,723,331 | 11/1955 | Tyrner . | |
| 2,906,472 | 9/1959 | Hannay et al. . | |
| 3,072,356 | 1/1963 | Leuthner . | |
| 3,120,357 | 2/1964 | Wood, Jr. . | |
| 3,197,153 | 7/1965 | Davidson . | |
| 3,323,752 | 6/1967 | Kurtz et al. . | |
| 3,395,308 | 7/1968 | Meyer . | |
| 3,502,280 | 6/1970 | Jessup et al. . | |
| 3,531,057 | 9/1970 | Way | 242/75.4 |
| 3,550,876 | 12/1970 | Machie . | |
| 3,584,809 | 6/1971 | Ogden, Sr. . | |
| 3,648,947 | 3/1972 | Shelton . | |
| 3,652,028 | 3/1972 | Ukai et al. . | |
| 3,669,370 | 6/1972 | Mason . | |
| 3,708,046 | 1/1973 | Brown . | |
| 3,794,267 | 2/1974 | Kimpton . | |
| 3,819,127 | 6/1974 | Priestly et al. . | |
| 3,913,854 | 10/1975 | McClure . | |
| 4,050,647 | 9/1977 | Linam . | |
| 4,102,513 | 7/1978 | Guard . | |
| 4,116,749 | 9/1978 | Dufort et al. . | |
| 4,166,589 | 9/1979 | Hoover | 53/390 |
| 4,248,392 | 2/1981 | Parry | 242/96 |
| 4,336,911 | 6/1982 | Fairchild . | |
| 4,339,022 | 7/1982 | Hoover . | |
| 4,375,279 | 3/1983 | Koch . | |
| 4,387,552 | 6/1983 | Lancaster | 53/587 X |
| 4,477,037 | 10/1984 | Goldstein | 242/96 X |
| 4,522,348 | 6/1985 | Strout et al. . | |
| 4,535,951 | 8/1985 | Riemenschneider | 242/75.4 |

*Primary Examiner*—John Sipos

*Attorney, Agent, or Firm*—Varnum, Riddering, Schmidt & Howlett

[57] ABSTRACT

A stretch film wrapping device for rotatably supporting a roll of film and dispensing the film at a selected tension includes a base member, a hub member having a device for mounting a roll of stretchable film, a shaft, a means for joining the shaft to the base and hub members to permit rotation of the hub member with respect to the base member. The means joining the shaft to the base and hub members includes a friction device for resisting rotation of the hub member with respect to the base member. The friction device includes a pair of friction surfaces mounted on the shaft. One of the friction surfaces is non-rotatably mounted to the base member and the other is non-rotatably mounted to the hub member. The friction device retards rotation of the hub member with respect to the base member. Each of the friction surfaces has an annular area extending radially outward from the shaft for frictional contact between the friction surfaces. A compressible device is mounted on the shaft for exerting through the shaft a selected force between the two friction surfaces. In this manner, a selected frictional force is maintained between the frictional surfaces for retarding rotation of the hub member with respect to the base member.

25 Claims, 9 Drawing Figures

STRETCH FILM WRAPPING DEVICE

BACKGROUND OF THE INVENTION

1. Field of the Invention

This invention relates to a stretch film wrapping device, and, more particularly, to a device for rotatably supporting a roll of plastic film for tension stretch wrapping of objects, containers and the like.

2. Background of the Invention

In shipping and storing goods, plastic stretch film can be used to both protect and secure a load. The advantages of the use of plastic stretch film are numerous. The stretch film produces a tight wrap and provides protection to the wrapped load from damage due to weather, abrasion, punctures, and the like. The plastic stretch film is of relatively low cost and does not require the use of adhesives, clips or other fasteners. For this reason, the use of plastic stretch film can reduce both material and labor costs.

In order for plastic stretch film to be utilized in an optimum manner, however, the film must be applied to the load at the appropriate tension. If the film is stretched too tight, the film will be difficult to wrap about the load and may break or tear. If the tension in the film is insufficient, the film will not conform to the shape of the load and the film wrap will be undesirably loose. The most important features of a proper wrap are the uniformity and the proper tension of the plastic as it is applied. The proper tension imparted to the film as it is applied results in the desired degree of "stretch" being given the film. The control of the tension must be sensitive and accurate because too much tension will cause the film to undergo plastic deformation and too little tension will prevent a sufficiently tight fit of the film about the package to be wrapped. The sensitivity and accuracy with which the tension must be applied to the film is especially important where the film is of relatively narrow width.

A variety of machines have been developed for applying plastic stretch film. An example of one of these devices is shown in Rimenschneider, III, No. 4,535,951, issued Aug. 20, 1985. The Rimenschneider patent discloses a stretch film wrapping device for two-handed use wherein the roll of film is clamped between two hubs. Two-handed devices or other bulky devices are inappropriate for "orbiting" above the package to be wrapped so as to band or bundle the package with film in both the vertical and horizontal planes.

The devices designed for dispensing plastic stretch film, however, are generally not adapted to permit quick on or off changing of stretch film rolls.

SUMMARY OF THE INVENTION

According to the invention, there is provided a stretch film wrapping device for rotatably supporting a roll of film and dispensing the film at a selected tension. The wrapping device includes a base member, a hub member which can mount a roll of film, and a shaft. The base member and hub members are joined together so as to permit rotation of the hub with respect to the base. A friction device is included to resist rotation of the hub with respect to to the base member. The friction device includes a pair of friction surfaces which are mounted on the shaft. One of the friction surfaces is non-rotatably mounted to the base and the other is non-rotatably mounted to the hub during retarded rotation of the hub with respect to the base. Each of the friction surfaces has an annular area extending substantially radially outward from the shaft for frictional contact with the other friction surface. The wrapping device also includes a compressible device which is mounted on the shaft for exerting through the shaft a selected force between the two frictional surfaces. In this manner, a selected frictional force is maintained between the frictional surfaces so as to oppose rotation of the hub with respect to the base.

The shaft can be a threaded shaft and the compressible device can include a spring device mounted coaxially on the shaft. The base member can include a hollow tubular handle having at least one open end.

In another embodiment, the base member can include a fixed support member having a recess therein. A plate member can be included to cover the recess. The plate member can have an aperture extending there through adapted to receive the threaded shaft.

A retainer can be mounted on the threaded shaft. The spring device exerts a force against this retainer. The threaded shaft can be disposed so as to extend through the aperture in the plate member so that a portion of the threaded shaft is located within the hub member. A plug member can be mounted non-rotatably and coaxially on the threaded shaft and fixed with respect to the hub member. The spring device can include a plurality of Belleville spring washers mounted coaxially on the threaded shaft intermediate between the retainer and the plug member. The spring device can exert a force against the plug member.

In another embodiment of the invention, a retainer can be mounted on the threaded shaft. The spring device exerts a force against this retainer. The threaded shaft can extend through an aperture in the hub so that the threaded shaft extends through the open end of the tubular handle. The wrapping device can also include a plug member mounted coaxially on the shaft, and the spring device can constitute a plurality of Belleville spring washers mounted on the shaft between the retainer and the plug member.

In a further embodiment of the invention, the hub member can be an elongated tubular member. In this embodiment, the threaded shaft can be located so that a portion of it is located within the hub member. A plug member can be mounted coaxially on the threaded shaft and a spring device can be located between an end of the shaft and the plug member.

In yet another embodiment of the invention, the threaded shaft can be located so that it extends through an aperture in the face of the hub. A portion of the threaded shaft is located within the tubular handle. A plug member can be mounted coaxially on the threaded shaft and fixed in location with respect to the tubular handle. A plurality of Belleville spring washers can be mounted coaxially on the threaded shaft between one end of the shaft and a face of the hub. An adjusting means can also be mounted on the threaded shaft for adjusting the position of a retainer with respect to the threaded shaft. This adjusting means can be an adjusting knob mounted non-rotatably to the retaining means.

The invention also provides for a system for stretch wrapping packages, including a plurality of rollers spaced at pre-selected intervals. These rollers include a dispensing roller for dispensing a roll of stretchable film and a plurality of guide rollers arranged to receive film dispensed from the roll of stretchable film on the dispensing roller. At least one of the rollers includes a stretch film wrapping device according to the invention.

The invention is particularly suitable for quick and easy changing of rolls of plastic film. Further, it provides a stretch film wrapper which can be held by a single hand orbiting packages in both horizontal and vertical planes.

DETAILED DESCRIPTION OF THE DRAWINGS

Figure 1:
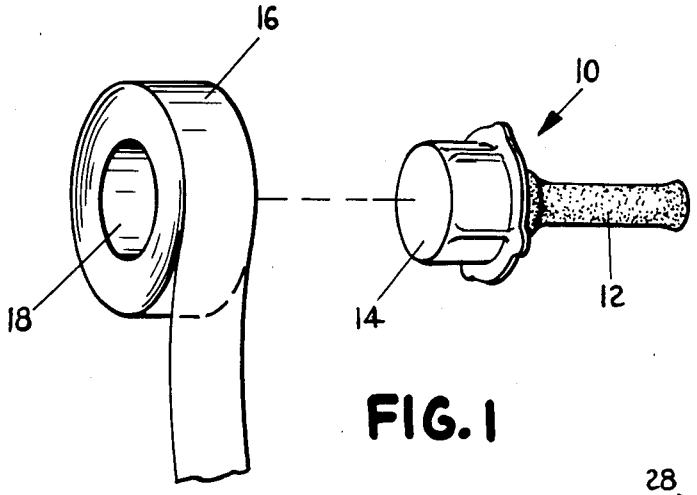
FIG. 1 is a perspective view of a film wrapping mechanism according to the invention.

Referring now to the drawings and, in particular, to FIG. 1, a film wrapping device 10 is shown. Film tensioning device 10 comprises a handle 12 and a hub 14. Hub 14 is sized so as to fit snugly within a hollow core 18 of a roll 16 of stretchable film.

Figure 2:
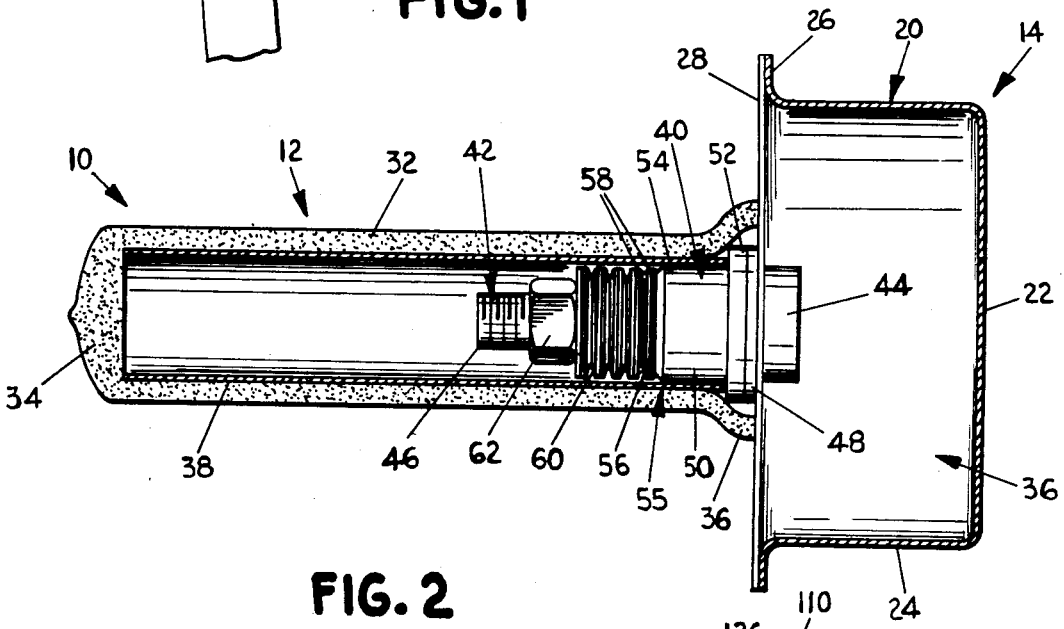
FIG. 2 is a partial sectional view of a film wrapping mechanism shown in FIG. 1.

As can be seen in FIG. 2, hub 14 comprises a cylindrical cap 20 having a top 22 and cylindrically shaped sidewall 24. Sidewall 24 terminates in an outwardly turned lip 26 extending around cylindrical cap 20. Hub 14 also comprises a flat circular plate having an aperture extending therethrough. Lip 26 of cylindrical cap 20 is adjacent circular plate 28 and joined thereto by means of welds (not shown). Cylindrical cap 20 and flat circular plate 28 together define a hollow interior 30.

As can further be seen in FIG. 2, handle 12 comprises a hollow grip 32 having a closed-end 34 and a flared, open end 36 so that grip 32 has a somewhat test tube shape. Handle 12 further comprises a tubular liner 38 located within grip 32.

As can further be seen in FIG. 2, a tensioning means 40 is located within wrapping device 10 so as to permit hub 14 to rotate with respect to handle 12 in a manner so as to impart a desired degree of tension to the stretchable film 16 as the film is dispensed. Tensioning mechanism 40 comprises a threaded shaft 42 having a head 44 and a threaded neck 46. Threaded shaft 42 is disposed so that head 44 is within the interior 30 of hub 14. Threaded neck 46 extends through the aperture in circular plate 28 and into handle 12. A friction pad 48 having a circular washer shape and having an aperture extending therethrough adapted to receive threaded neck 46 is mounted on threaded neck 46 adjacent circular plate 28 so that friction pad 48 lies within the flared portion 36 of grip 32. A plug 50 having an aperture extending therethrough adapted to received threaded neck 46 is mounted on threaded neck 46 adjacent friction pad 48. Plug 50 has a top portion 52 with a surface area substantially congruent to that of friction pad 48 and which seats in flared portion 36 of grip 32. Plug 50 also comprises a bottom portion 54 adapted to be press-fit snugly into liner 38 so that plug 50 remains stationary with respect to liner 38. The use of friction pad 48 is not necessary to the invention, however, and plug 50 can be in direct contact with hub 14. In the event a friction pad is not used, plug 50 is made of a ultra-high molecular weight polyethylene or other material suitable for high wear having a low coefficient of friction with respect to the material comprising circular plate 28. Friction pad 48 can be a metal washer or other material selected to provide the desired frictional interface. Friction pad 48 can be utilized where both hub 14 and plug 40 are formed of similar polymer materials.

Figure 3:
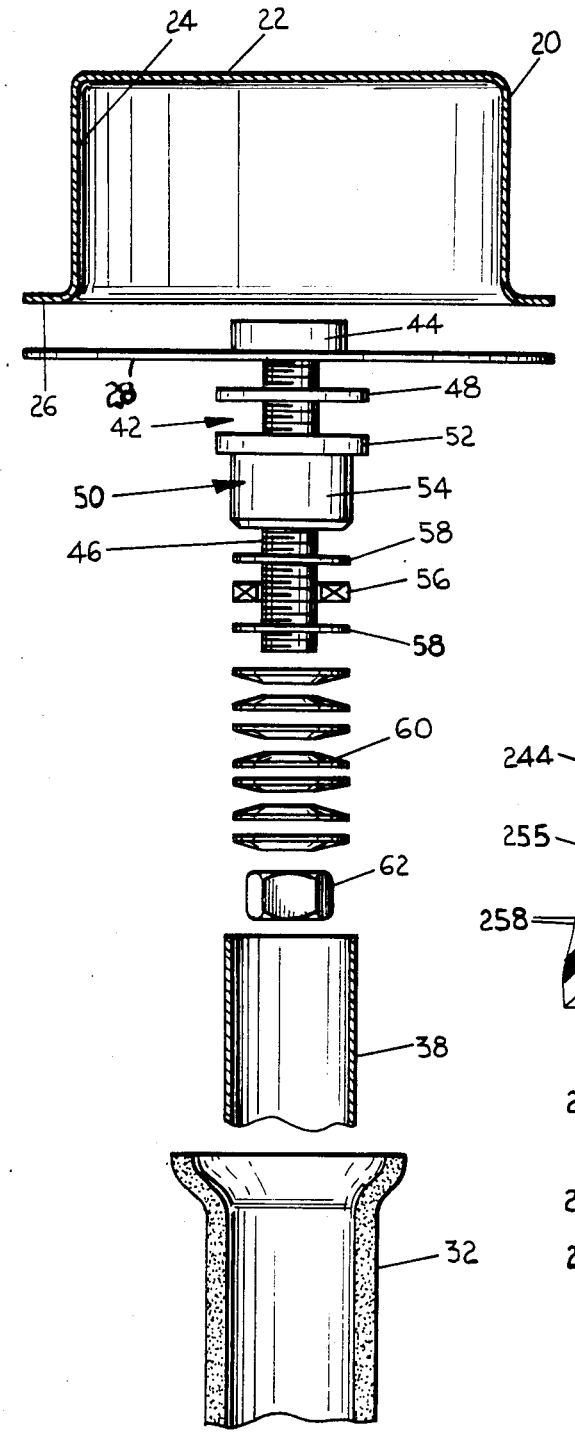
FIG. 3 is an exploded view of the film wrapping mechanism shown in FIG. 2.

As can be seen in FIGS. 2 and 3, needle thrust bearing assembly 55 is mounted on threaded neck 46 within liner 38. Needle thrust bearing 56, and thrust washers 58 separate plug 50 from a plurality of spring washers 60. As can best be seen in FIG. 4, the spring washers 60 comprise a plurality of concave spring washers mounted in series. This arrangement of the spring washers permits the greatest degree of tensioning sensitivity. In the alternative, spring washers 60 can be mounted in parallel so as to increase the strength of the spring washers. It should be understood that, although spring washers are described herein, any suitable resilient means such as a spring or resilient pad could be utilized in place of the spring washers. A nut 62 is threadably mounted on threaded neck 46 adjacent spring washers 60 and in contact therewith to maintain the compression of the spring washers 60.

During assembly, nut 62 is located at a position on threaded neck 46 so as to provide the desired degree of compression of spring washers 60. After pre-selecting the position of nut 62, tensioning mechanism 40 and hub 14 are mounted to handle 12 by press-fitting the bottom portion 54 of plug 50 into liner 38. Once the tensioning device 40 is mounted within liner 38, hub 14 is able to rotate with respect to handle 12 about threaded shaft 42. Threaded shaft 42, friction pad 48 (if used), plug 50, needle thrust bearing 56, thrust washers 58, spring washers 60 and nut 62 all remain stationary with respect to handle 12 as hub 14 is rotated.

In use, as stretchable film is drawn from roll 16 mounted on hub 14, handle 12 is held stationary by an operator's hand and hub 14 rotates with respect to handle 12. Spring washers 60, having been precompressed by the positioning of nut 62 prior to assembly of the tensioning device 10 exert a force on nut 62. This force is translated by means of threaded neck 46 into a force on head 44 acting to urge circular plate 28 against friction pad 48 if a friction pad is used or against plug 50 where no friction pad is used. In this manner, the force exerted by spring washers 60 increases the frictional force acting between the rotatable circular plate 28 and the fixed friction plate 48 and, thereby, acts to retard rotation of hub 14. As a result, a constant preselected force is required to be exerted on stretchable film 16 in order to cause hub 14 to rotate. By appropriate preselection of the position of nut 62 the force exerted by spring washers 60 and, therefore, the force required to be exerted on the stretchable film 16 in order to rotate hub 14 can be preselected. Thus, the desired amount of tension in stretchable film 16 can be predetermined.

Figure 4:
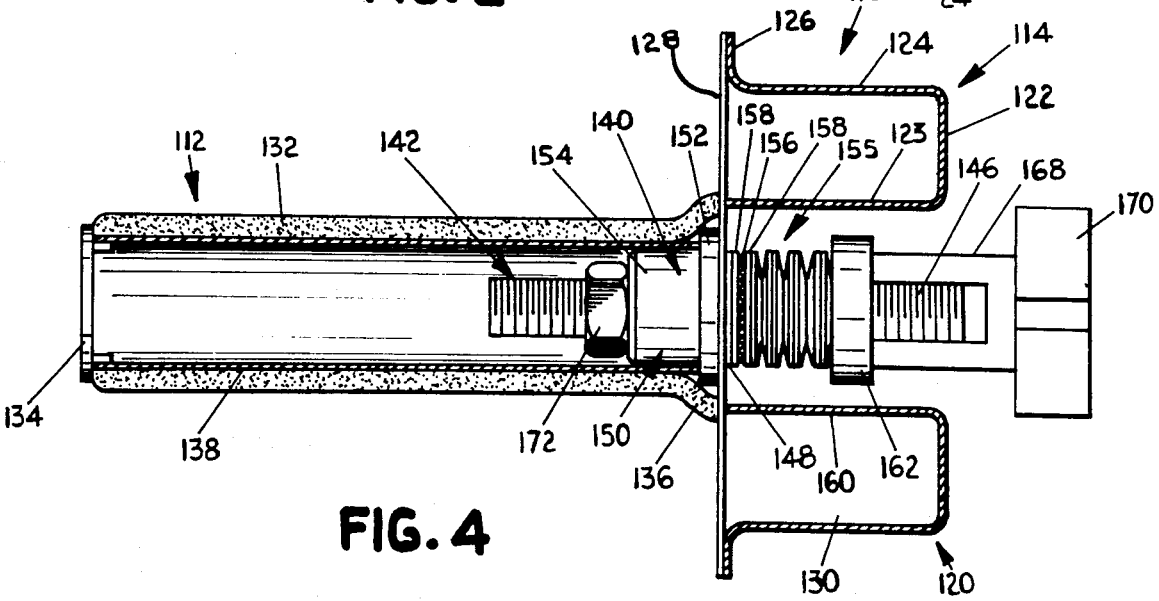
FIG. 4 is a partial sectional view of an adjustable film tensioning device according to a second embodiment of the invention.

In FIG. 4 a film wrapping device 110 comprises a handle 112 and a hub 114. Hub 114 has a donut shape and comprises a cylindrical outerwall 124, a donut shaped ring forming a top wall 122, and a cylindrical inner wall 123. Cylindrical outer wall 124 terminates in an outwardly extending lip 126. Hub 114 further comprises a flat cylindrical plate 128 having an aperture (not shown) extending therethrough. Outwardly extending lip 126 is adjacent circular plate 128 and is secured thereto by means of welds (not shown). Hub 114 thereby comprises a donut-shaped cap 120 and a circular plate 128 which together define a ring shaped interior volume 130.

Handle 112 comprises a tubular grip 132 having a cylindrical shape and being open at both ends thereof. A flared end 136 of grip 132 is disposed adjacent to hub 114. A cylindrical liner 138 is disposed snugly within grip 132. An end cap 134 encloses an end of handle 112 opposite hub 114.

Adjustable wrapping device 110 further comprises a tensioning means 140 which is adapted so as to permit hub 114 to rotate with respect to handle 112 only when a selected rotational force is applied to hub 114, for example, by tension applied to stretchable film (not shown) mounted to hub 114.

Tensioning means 140 comprises a threaded shaft at 142 having a threaded neck 146. Threaded bolt 142 is disposed so that it extends through an aperture extending through circular plate 128. A plug 150 is press-fit within liner 138 and is adjacent circular plate 128. Plug 150 comprises a relatively large diameter shoulder 152 and a smaller diameter portion 154, both having an aperture (not shown) extending therethrough adapted to receive threaded neck 146. Plug 150 is made of an ultra high molecular weight polyethylene having a low coefficient of friction with respect to a material comprising circular plate 128 which is typically made of metal.

As can further be seen in FIG. 4, a friction pad 148 having an aperture extending therethrough (not shown) can be mounted on threaded neck 146. Friction pad 148 is, however, not necessary to the invention and can be omitted if so desired. A needle thrust bearing assembly 155 comprising a needle thrust bearing 156 having thrust washers 158 on either side thereof, is mounted on threaded neck 146. Thrust needle bearing 156 and thrust washers 158 are located adjacent friction pad 148 (if a friction pad is utilized) on a side thereof opposite handle 112.

As can be seen in FIG. 4, a plurality of spring washers 160 are disposed on threaded neck 146 and are maintained in a desired compressed state by means of a collar 162 mounted on threaded neck 146. Collar 162 made of a polymer material and having a somewhat donut-like shape is pressed against spring washers 160 by stem 168 of a knob 170. Knob 170 has female threads adapted to receive an end of threaded shaft 142. A nut 172 is threaded onto threaded shaft 142 so that plug 150 is disposed between nut 172 and hub 114.

In use, an operator can adjust knob 170 to move collar 162 with respect to threaded neck 146 and, thereby, either increase or decrease the compression of spring washers 160. Collar 162 is positioned so as to compress spring washers 160, whereby a force is exerted by spring washers 160 against thrust needle bearing assembly 156 and a force is exerted against pressure pad 148, thereby forcing plug 150 against circular plate 128. In this manner, the frictional force between circular plate 128 and plug 150 opposing rotation of hub 114 with respect to handle 112 is relatively high.

The force exerted on stretchable film mounted on hub 114 which must be exerted in order to initiate rotation of hub 114 with respect to handle 112 can be lessened and, in turn, the force exerted on stretchable film mounted on hub 114 necessary to initiate rotation on hub 114 with respect to handle 112 can be reduced by loosening collar 162 by means of knob 170. In this manner, the tension exerted on the dispensed stretchable film can be selected by the operator by adjustment of knob 170. The low coefficient of friction of plug 150 permits relatively sensitive adjustment of the frictional force opposing rotation of hub 114 with respect to handle 112.

Figure 5:
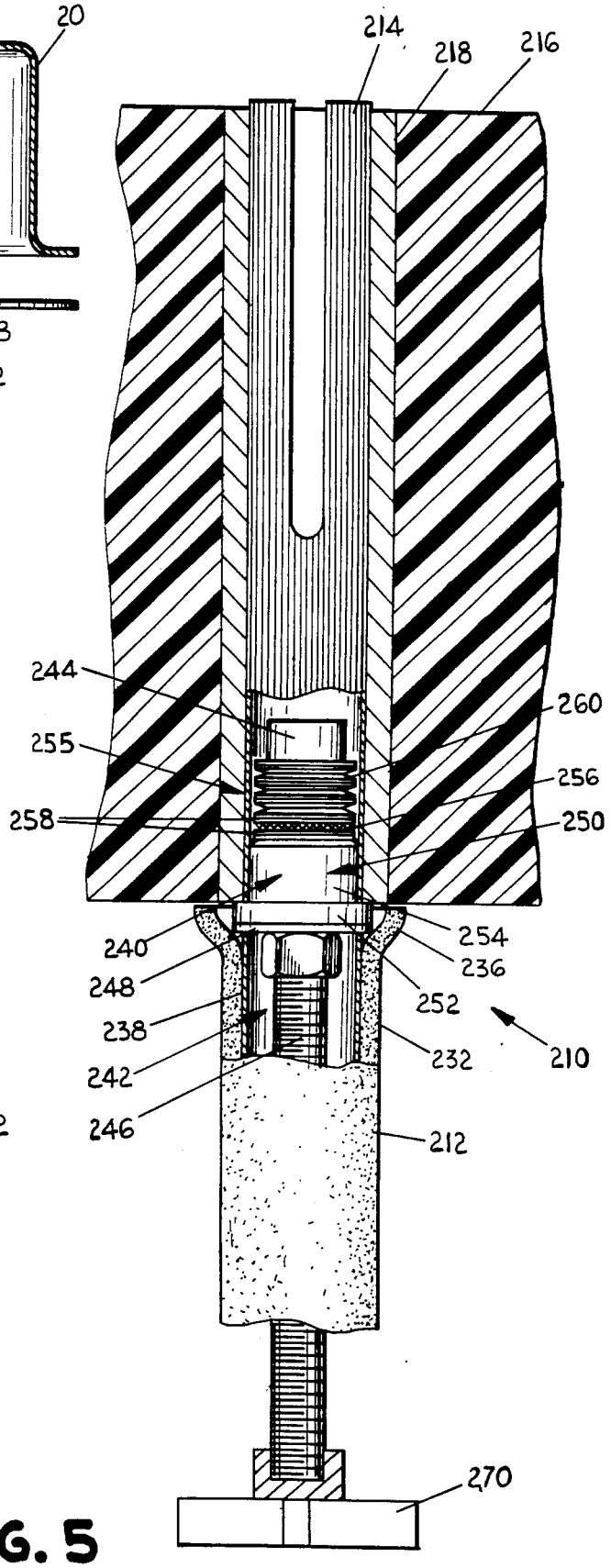
FIG. 5 is a film wrapping mechanism for use with elongated rolls of film according to a third embodiment of the invention.

FIG. 5 shows a film wrapping device 210 having a handle 212 and an elongated cylindrical aluminum hub 214. A roll of stretchable film material 216 having a core 218 is mounted on aluminum hub 214. Handle 212 comprises a tubular grip 232 having a flared end 236. A tubular liner 238 is disposed within grip 232.

A tensioning mechanism 240 is adapted to permit rotation of cylindrical hub 214 with respect to handle 212 and to impart a desired degree of tensioning to stretchable film 216. Tensioning mechanism 240 comprises a threaded shaft 242 having a head 244 and a threaded neck 246. Threaded shaft 242 is disposed so that head 244 is located within hub 214. A plug 250 having an aperture (not shown) extending therethrough adapted to receive a threaded neck 246 is mounted on threaded neck 246. Plug 250 has a relatively small diameter portion 254 which is press-fit into tubular hub 214 so as to maintain plug 250 in a stationary position with respect to hub 214. Hub 250 further comprises a relatively large diameter portion 252 disposed within the flared portion 236 of grip 232.

Spring washers 260 and a thrust needle bearing assembly 255 comprising a thrust needle bearing 256 and thrust washers 258 is mounted on threaded neck 246 between head 244 and plug 250. [In an additional embodiment, spring washers 260 and thrust needle bearing assembly 255 can be mounted on threaded neck 246 intermediate between a friction pad 248 and a nut and flat washer (not shown). In this embodiment, a lock nut (not shown) is utilized in place of head 244 and the lock nut abuts plug 50.] A friction pad 248 having an aperture extending therethrough adapted to receive threaded neck 246 mounted adjacent the wide diameter portion 252 of plug 250. Friction pad 248 is secured as by welds (not shown) to tubular liner 238. A nut 262 is mounted on threaded neck 246 adjacent friction pad 248. A knob 270 is press-fit onto threaded shaft 242 so that threaded shaft 242 can be rotated with respect to handle 212.

In use, knob 270 can be rotated so as to turn threaded shaft 242. In this manner, head 244 can be drawn toward or backed away from spring washers 260 so as to produce a desired amount of compression in spring washers 260. This compression is produced by the force exerted on spring washers 260 by head 244. The opposing force exerted by spring washers 260 against head 244 urges nut 262 against friction pad 248. Friction pad 248 is thereby urged against plug 250. The force exerted thereby determines the frictional force between plug 250 and friction pad 248 which resists rotation of hub 214 with respect to handle 212. In this manner, the force necessary to be exerted on a stretchable film mounted on hub 214 can be pre-selected and maintained at a constant force. Thus, the desired degree of tensioning of the stretchable film can be obtained.

Figure 6:
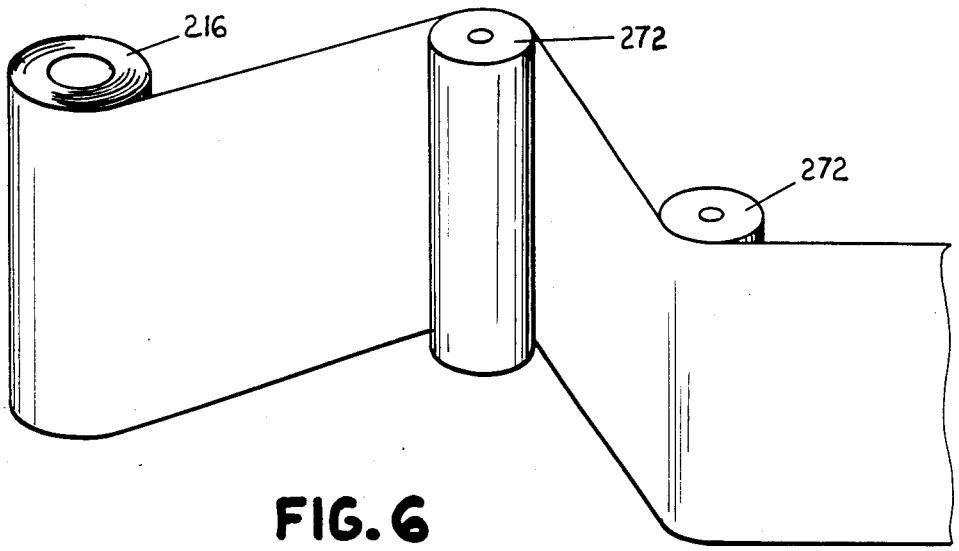
FIG. 6 is a perspective representation showing the use of the invention to dispense film with the aid of dummy rolls.
Figure 8:
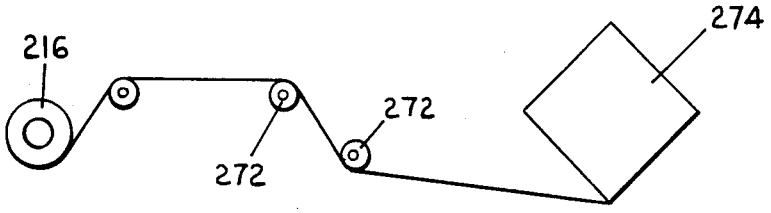
FIG. 8 is a schematic plan view of one dispensing system in which the invention can be utilized.
Figure 9:
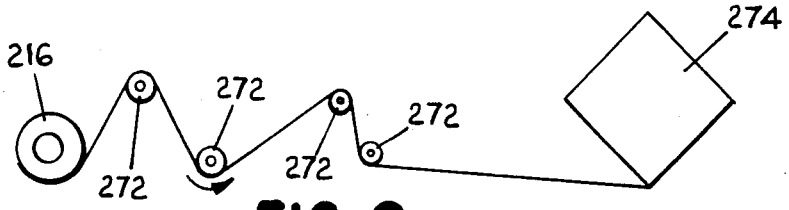
FIG. 9 is a schematic plan view of another dispensing system in which the invention can be utilized.

As can be seen in FIG. 6, a large roll of stretchable film 216 can be drawn from a film tensioning device according to the invention and passed over dummy rolls 272 so as to avoid necking of the film. FIGS. 8 and 9 show additional configurations of dummy rolls 272 for withdrawing stretchable film from a roll 216 without necking and maintaining a constant pre-selected tension in the film. The film so dispensed can be utilized to wrap a desired article 274.

It should be understood that the stretch film wrapping device of the invention can be utilized at the rolls denoted 272 in FIGS. 6, 8, and 9 in addition to, or in place of, the stretch film wrapping device at 216. The use of the invention at 272 permits film to be given a selected amount of stretch by the application of a force to the film without that amount of stretch being affected by the ever-changing diameter of the supply roll at 216. Similarly, as can be seen in FIG. 9, where a plurality of stretch film wrapping devices are utilized at 272, a selected amount of stretch can be imparted to the film between any two rolls so that any variation in force applied to the film as a result of the rotation of object 272 (which may be of irregular shape) does not have a significant adverse impact on the desired degree of stretch imparted to the film.

Figure 7:
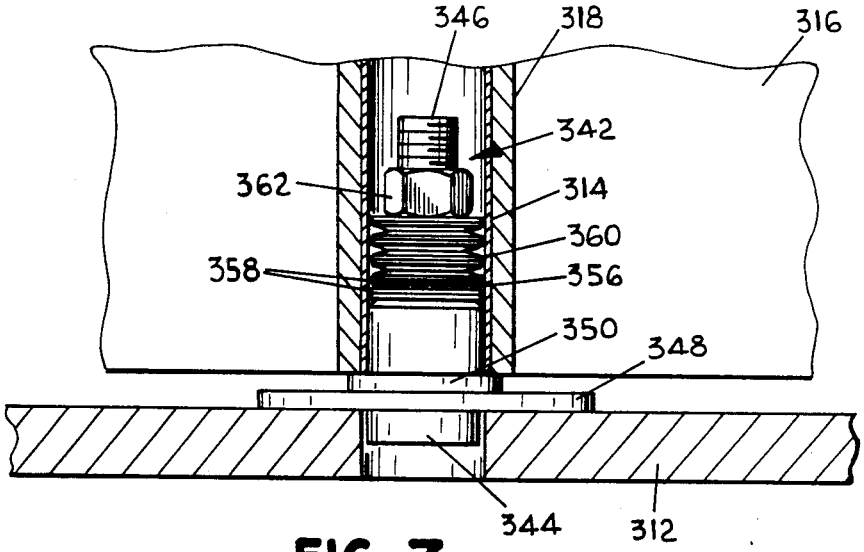
FIG. 7 is a partial sectional view of still another embodiment of the invention.

FIG. 7 depicts a film tensioning device according to the invention similar to that depicted in FIG. 5. As shown in FIG. 7, a cylindrical hub 314 is rotatable with respect to a work surface 312. A plug 350 is press-fit into hub 314 and a threaded shaft 342 extends therethrough so that a head 344 of threaded shaft 342 is disposed flush within the work surface 312 and a threaded neck 346 of threaded shaft 342 is disposed within hub 314.

A nut 362 is mounted on threaded shaft 346 and maintains spring washers 360 in compression against a tension washer 356 located between two conventional washers 358. A friction pad 348 is secured to plate 312 and is disposed between head 344 and plug 350 so that the force exerted by spring washers 360 urges plug 350 against friction pad 348.

In this manner, the frictional force between plug 350 and friction pad 348 opposing rotation of plug 350 with respect to friction pad 348 can be selected and maintained at the constant selected force. Thus, the force necessary to be exerted on stretchable film 316 mounted in roll form on a core 318 which is, in turn, mounted on hub 314 can be selected and maintained. In this manner, the film dispensed is at a constant preselected tension.

While the preferred embodiments of the invention have been described and illustrated, it will be obvious to those skilled in the art that various changes and modifications can be made without departing from the spirit of the present invention. Accordingly, the scope of the invention is deemed to be limited only by the appended claims.

The embodiments of the invention in which an exclusive property property or privilege is claimed are defined as follows:

1. A stretch film wrapping device for rotatably suppoorting a roll of film and dispensing said film at a selected tension, including a base member, a hub member having a means for mounting a roll of film; a shaft; a means joining said shaft to said base member and hub member to permit rotation of said hub member with respect to said base member, including a friction means to resist rotation of said hub member with respect to said base member, wherein the improvement comprises:

said friction means having a pair of friction surfaces mounted on said shapft member, one of said friction surfaces is non-rotatably mounted to said base member and the other of which is non-rotably mounted on said hub member during retarted rotation of said hub member with respect to said base member each of said surfaces having an annular area extending substantially radially outward from said shaft member for frictional contact with the other of said surfaces;

at least one of said friction surfaces being made of a durable material having a low coefficient of friction so as to permit a broad range of braking forces to be exerted by said friction means;

compressible means mounted on said shaft member for exerting through said shaft member a selected force between said two frictional surfaces;

a retaining means against which said compressible means exerts a force mounted on said shaft; and means for adjustably securing said retaining means on said shaft;

whereby a selected frictional force is maintained between said pair of frictional surfaces so as to oppose rotation of said hub member with respect to said base member.

2. A stretch film wrapping device according to claim 1 wherein said shaft member comprises a threaded shaft.

3. A stretch film wrapping device according to claim 2 wherein said compressible means comprises a spring means mounted coaxially on said shaft.

4. A stretch film wrapping device according to claim 3 wherein said base member comprises a hollow tubular handle having at least one open end.

5. A stretch film wrapping device according to claim 3 wherein said base member comprises a fixed support member having a recess therein.

6. A stretch film wrapping device according to claim 5 and further comprising a plate member secured to said base member so as to cover said recess and having an aperture extending therethrough adapted to receive said threaded shaft.

7. A stretch film wrapping device according to claim 6 wherein a retaining means against which said spring means exerts a force is mounted on said threaded shaft.

8. A stretch film wrapping device according to claim 7 wherein said threaded shaft is disposed so as to extend through said aperture in said plate so a portion of said threaded shaft is disposed within said hub member.

9. A stretch film wrapping device according to claim 8 and further comprising a plug member mounted non-rotatably and coaxially on said threaded shaft and fixed with respect to said hub member.

10. A stretch film wrapping device according to claim 9 wherein said spring means comprise a plurality of Belleville spring washers mounted coaxially on said threaded shaft intermediate between said retaining means and said plug member.

11. A stretch film wrapping device according to claim 10 wherein said spring means exerts force against said plug member.

12. A stretch film wrapping device according to claim 4 wherein said threaded shaft extends through an aperture in said hub member so that said threaded shaft extends through said open end of said tubular handle.

13. A stretch film wrapping device according to claim 12 and further comprising a plug member mounted coaxially on said threaded shaft and fixed with respect to said tubular handle.

14. A stretch film wrapping device according to claim 13 wherein said spring means comprises a plurality of Belleville spring washers mounted coaxially on said threaded shaft intermediate between said retaining means and said plug member.

15. A stretch film wrapping device according to claim 4 wherein said hub member comprises an elongated tubular member.

16. A stretch film wrapping device according to claim 15 wherein said threaded shaft is disposed so that a portion of said threaded shaft is located within said hub member.

17. A stretch film wrapping device according to claim 16 and further comprising a plug member mounted coaxially on said threaded shaft.

18. A stretch film wrapping device according to claim 17 wherein said spring means are mounted coaxially on said threaded shaft intermediate between an end of said shaft and said plug member.

19. A stretch film wrapping device according to claim 4 wherein said threaded shaft extends through an aperture in a face of a hub so that a portion of said threaded shaft is disposed within said tubular handle.

20. A stretch film wrapping device according to claim 19 and further comprising a plug member mounted coaxially with said threaded shaft and fixed with respect to said tubular handle.

21. A stretch film wrapping device according to claim 20 wherein said spring means comprises a plurality of Belleville spring washers mounted coaxially on said threaded shaft intermediate between an end of said threaded shaft and at least one face of said hub member.

22. A stretch film wrapping device according to claim 21 and further comprising an adjusting means mounted said threaded shaft adapted to change the position of said retaining means with respect to said threaded shaft.

23. A stretch film wrapping device according to claim 22 wherein said adjusting means comprises an adjusting knob mounted non-rotatably to said retaining means.

24. A system for stretch wrapping packages, comprising:

a plurality of rollers spaced at pre-selected intervals, including and dispensing roller for dispensing a roll of sketchable film arranged to receive said film dispensed from said roll of stretchable film material on said dispensing roller, at least one of said rollers having a stretch film wrapping device for rotatably supporting a roll of film and dispensing said film at a selected tension, including a base member, a hub member having a means for mounting a roll of film; a shaft; a means joining said shaft to said base member and hub member to permit rotation of said hub member with respect to said base member, including a friction means to resist rotation of said hub member with respect to said base member, said friction means having a pair of friction surfaces mounted on said shaft member, one of said friction surfaces is nonrotatably mounted to said base member and the other of which is non-rotatably mounted on said hub member during retarded rotation of said hub member with respect to said base member, each of said surfaces having an annular area extending substantially radially outward from said shaft member for frictional contact with the other of said surfaces;

at least one of said friction surfaces being made of a durable material having a low coefficient of friction so as to permit a broad range of braking forces to be exerted by said friction means;

compressible means mounted on said shaft member for exerting through said shaft member a selected force between said two frictional surfaces;

a retaining means against which said compressible means exerts a force mounted on said shaft; and means for adjustably securing said retaining means on said shaft;

whereby a selected frictional force is maintained between said pair of frictional surfaces so as to oppose rotation of said hub member with respect to said base member.

25. A stretch film wrapping device according to claim 1 wherein said one of said friction surfaces is made of ultra-high molecular weight polyethelene.

* * * * *